US010766156B2

(12) United States Patent
Park et al.

(10) Patent No.: US 10,766,156 B2
(45) Date of Patent: Sep. 8, 2020

(54) RAZOR CARTRIDGE ASSEMBLY

(71) Applicant: DORCO CO., LTD., Seoul (KR)

(72) Inventors: Semin Park, Seoul (KR); Dongil Kim, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/141,830

(22) Filed: Sep. 25, 2018

(65) Prior Publication Data

US 2019/0099905 A1 Apr. 4, 2019

(30) Foreign Application Priority Data

Sep. 29, 2017 (KR) ..... 10-2017-0127831

(51) Int. Cl.

| | |
|---|---|
| ***B26B 21/52*** | (2006.01) |
| ***B26B 21/40*** | (2006.01) |
| ***B26B 21/22*** | (2006.01) |
| ***B26B 21/44*** | (2006.01) |

(52) U.S. Cl.

CPC ..... *B26B 21/521* (2013.01); *B26B 21/225* (2013.01); *B26B 21/4012* (2013.01); *B26B 21/4018* (2013.01); *B26B 21/443* (2013.01)

(58) Field of Classification Search

CPC ..... B26B 21/52; B26B 21/521; B26B 21/522; B26B 21/523; B26B 21/525; B26B 21/08; B26B 21/10; B26B 21/14; B26B 21/22; B26B 21/222; B26B 21/225;

(Continued)

(56) References Cited

U.S. PATENT DOCUMENTS 4,266,340 A * 5/1981 Bowman ..... B26B 21/225 30/47
4,599,793 A 7/1986 Iten
5,687,485 A 11/1997 Shurtleff et al.

(Continued)

FOREIGN PATENT DOCUMENTS

GB 2064408 6/1981
JP 4416598 2/2010

(Continued)

OTHER PUBLICATIONS

European Patent Office Application Serial No. 18196918.9, Search Report dated Oct. 30, 2018, 7 pages.

(Continued)

*Primary Examiner* — Andrea L Wellington
*Assistant Examiner* — Richard D Crosby, Jr.
(74) *Attorney, Agent, or Firm* — Lee, Hong, Degerman, Kang & Waimey

(57) ABSTRACT

Provided is a razor cartridge assembly including: one or more razor blades, each having a cutting edge, a blade housing configured to accommodate the one or more razor blades in a longitudinal direction of the blade housing, and a connector configured to be coupled to a back of the blade housing, wherein the blade housing includes a rib disposed at the back of the blade housing and positioned in a direction perpendicular to the longitudinal direction, and the connector includes an inner cantilever and an outer cantilever opposite the inner cantilever, wherein the inner cantilever and the outer cantilever are configured to engage with the rib to couple the blade housing and the connector together.

17 Claims, 16 Drawing Sheets

(58) Field of Classification Search
CPC ..... B26B 21/227; B26B 21/4012; B26B 21/4018; B26B 21/4025
See application file for complete search history.

(56) References Cited

U.S. PATENT DOCUMENTS

| | | | | |
|---|---|---|---|---|
| 5,761,814 | A | 6/1998 | Anderson et al. | |
| 5,784,790 | A | 7/1998 | Carson, III et al. | |
| 5,956,848 | A | 9/1999 | Tseng et al. | |
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 10,507,588 | B2 * | 12/2019 | Provost | B26B 21/14 |
| 2003/0046819 | A1 | 3/2003 | Ferraro et al. | |
| 2006/0080838 | A1 * | 4/2006 | Johnson | B26B 21/222 30/50 |
| 2006/0174488 | A1 * | 8/2006 | Walker | B26B 21/225 30/50 |
| 2007/0289139 | A1 * | 12/2007 | Peyser | B26B 21/225 30/47 |
| 2008/0196251 | A1 * | 8/2008 | Royle | B26B 21/227 30/50 |
| 2009/0119924 | A1 * | 5/2009 | Bozikis | B26B 21/38 30/45 |
| 2010/0011583 | A1 * | 1/2010 | Efthimiadis | B26B 21/222 30/34.1 |
| 2010/0011584 | A1 * | 1/2010 | Efthimiadis | B26B 21/225 30/34.1 |
| 2010/0043242 | A1 * | 2/2010 | Stevens | B26B 21/225 30/527 |
| 2011/0192031 | A1 * | 8/2011 | Coresh | B26B 21/227 30/34.2 |
| 2011/0197450 | A1 * | 8/2011 | Taub | B26B 21/40 30/50 |
| 2011/0219620 | A1 * | 9/2011 | Rehbein | B26B 19/3813 30/34.1 |
| 2012/0005900 | A1 * | 1/2012 | Erndt | B26B 19/04 30/43.92 |
| 2012/0124840 | A1 * | 5/2012 | Iaccarino | B26B 21/225 30/50 |
| 2012/0210586 | A1 * | 8/2012 | Lelieveld | B26B 19/04 30/527 |
| 2013/0000127 | A1 * | 1/2013 | Coresh | B26B 21/22 30/41 |
| 2013/0312265 | A1 * | 11/2013 | Wilson | B26B 21/40 30/74 |
| 2014/0033538 | A1 * | 2/2014 | Peterson | B22F 3/1055 30/50 |
| 2014/0083265 | A1 * | 3/2014 | Provost | B26B 21/225 83/13 |
| 2014/0116211 | A1 * | 5/2014 | Griffin | B26B 21/522 83/13 |
| 2014/0165800 | A1 * | 6/2014 | Griffin | B05D 7/02 83/13 |
| 2014/0230252 | A1 * | 8/2014 | Davos | B26B 21/4031 30/50 |
| 2014/0373362 | A1 * | 12/2014 | Bozikis | B26B 21/40 30/50 |
| 2015/0158192 | A1 * | 6/2015 | Tucker | B26B 21/4081 83/13 |
| 2015/0174776 | A1 * | 6/2015 | Hawes | B26B 21/14 30/526 |
| 2015/0190935 | A1 * | 7/2015 | Griffin | B26B 21/225 132/200 |
| 2015/0190936 | A1 * | 7/2015 | Griffin | B26B 21/225 132/200 |
| 2015/0217466 | A1 * | 8/2015 | Leicht | B26B 21/4075 30/50 |
| 2015/0290819 | A1 * | 10/2015 | Giannopoulos | B26B 21/521 30/532 |
| 2015/0306777 | A1 * | 10/2015 | Georgakis | B26B 21/222 30/57 |
| 2015/0314465 | A1 * | 11/2015 | Giannopoulos | B26B 21/222 30/532 |
| 2015/0314466 | A1 * | 11/2015 | Papadopoulos-Papageorgis | B26B 21/222 30/532 |
| 2016/0039103 | A1 | 2/2016 | Worrick, III | |
| 2016/0250764 | A1 * | 9/2016 | Hashimoto | B26B 21/521 30/47 |
| 2019/0160699 | A1 * | 5/2019 | Park | B26B 21/4018 |

FOREIGN PATENT DOCUMENTS

| | | |
|---|---|---|
| KR | 100903191 | 6/2009 |
| KR | 101668230 | 10/2016 |
| KR | 101703508 | 2/2017 |
| KR | 101743128 | 6/2017 |
| KR | 101876233 | 7/2018 |
| WO | 00/16951 | 3/2000 |
| WO | 2001098041 | 12/2001 |

OTHER PUBLICATIONS

European Patent Office Application Serial No. 18196918.9, Communication under Rule 71(3) EPC dated Mar. 6, 2020, 40 pages.
Korean Intellectual Property Office Application No. 10-2017-0127831, Notice of Allowance dated Jun. 25, 2018, 2 pages.
Korean Intellectual Property Office Application No. 10-2017-0127831, Office Action dated Feb. 21, 2018, 5 pages.

* cited by examiner

RAZOR CARTRIDGE ASSEMBLY

Pursuant to 35 U.S.C. § 119(a), this application claims the benefit of earlier filing date and right of priority to Korean Patent Application No. 10-2017-0127831, filed on Sep. 29, 2017, the contents of which are all hereby incorporated by reference herein in its entirety.

BACKGROUND

1. Field

The present disclosure relates to a razor cartridge assembly, and more particularly, to a razor cartridge assembly having a connector detachable from a razor handle and assembled to a blade housing.

2. Description of the Related Art

A conventional razor, commonly known as a wet razor, includes a blade housing and a razor handle. The blade housing generally includes one or more blades disposed between a rear side of a guard bar and a front side of a cap. The blade housing is rotatably installed on the razor handle so that it can swivel with respect to the razor handle between a neutral position and a swivel position during use of the razor. This swiveling motion may be based on a rotation axis parallel to a direction (longitudinal direction of the blade housing) in which the razor blades are disposed in the blade housing.

Thus, when completely rotated in the direction of a cutting surface, the blade housing is at the neutral position. The swiveling motion of the blade housing between the neutral position and the swivel position with respect to the razor handle plays an important role because it allows the blade housing and related blades to continue contacting the cutting surface during use.

During normal shaving, the blade housing may swivel with respect to the razor handle in the direction of the swivel position as it is moved away from the cutting surface by a certain force. The force may include a frictional force caused by the cutting surface contacting the guard bar and a force required when the blades cut hair. In order to compensate for the characteristics of a cartridge that swivels away from the cutting surface, the razor may include a biasing member such as a spring plunger. The biasing member acts to keep the blade housing in contact with the cutting surface by applying force to the blade housing in the direction of the neutral position.

While an end of the razor handle can be directly coupled to the back of the blade housing as described above, the blade housing and the razor handle can also be connected using a connector for secure assembly or proper swiveling motion. To provide the swiveling motion of the blade housing in a razor having the connector, blade housing may swivel with respect to the connector or the connector fixedly coupled to the blade housing may swivel on an end of the razor handle.

According to a configuration in which the blade housing swivels with respect to the connecter, the connector may have a side detachably coupled to the blade housing and the other side coupled to an end of the razor handle. Here, the connector does not swivel with respect to the razor handle, whereas the blade housing swivels around the rotation axis parallel to the longitudinal direction of the razor cartridge with respect to the coupling end of the connector.

According to a configuration in which the connector swivels on an end of the razor handle, an end (for example, a plunger guard) of the razor handle detachably coupled to the connector swivels around the rotation axis with respect to the body of the razor handle. Here, no relative movement occurs between the blade housing and the connector.

If the end of the razor handle detachable from the connector swivels as in the latter configuration, it is necessary to ensure that the connector is easily assembled to the blade housing and is not detached from the blade housing after assembly. However, conventional connectors are not quickly and easily assembled to the blade housing or may be detached from the blade housing by an external force applied after assembly.

SUMMARY

Aspects of the present disclosure provide a razor cartridge assembly having a connector that can be quickly and easily assembled to a blade housing.

Aspects of the present disclosure also provide a razor cartridge assembly in which a connector may not be separated from a blade housing even when a considerable external force is applied after the connector is assembled to the blade housing.

However, aspects of the present disclosure are not restricted to the one set forth herein. The above and other aspects of the present disclosure will become more apparent to one of ordinary skill in the art to which the present disclosure pertains by referencing the detailed description of the present disclosure given below.

According to an aspect of the present disclosure, there is provided a razor cartridge assembly including: one or more razor blades, each having a cutting edge; a blade housing configured to accommodate the one or more razor blades in a longitudinal direction of the blade housing; and a connector configured to be coupled to a back of the blade housing, wherein the blade housing comprises a rib disposed at the back of the blade housing and positioned in a direction perpendicular to the longitudinal direction; and the connector comprises an inner cantilever and an outer cantilever opposite the inner cantilever, wherein the inner cantilever and the outer cantilever are configured to engage with the rib to couple the blade housing and the connector together.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
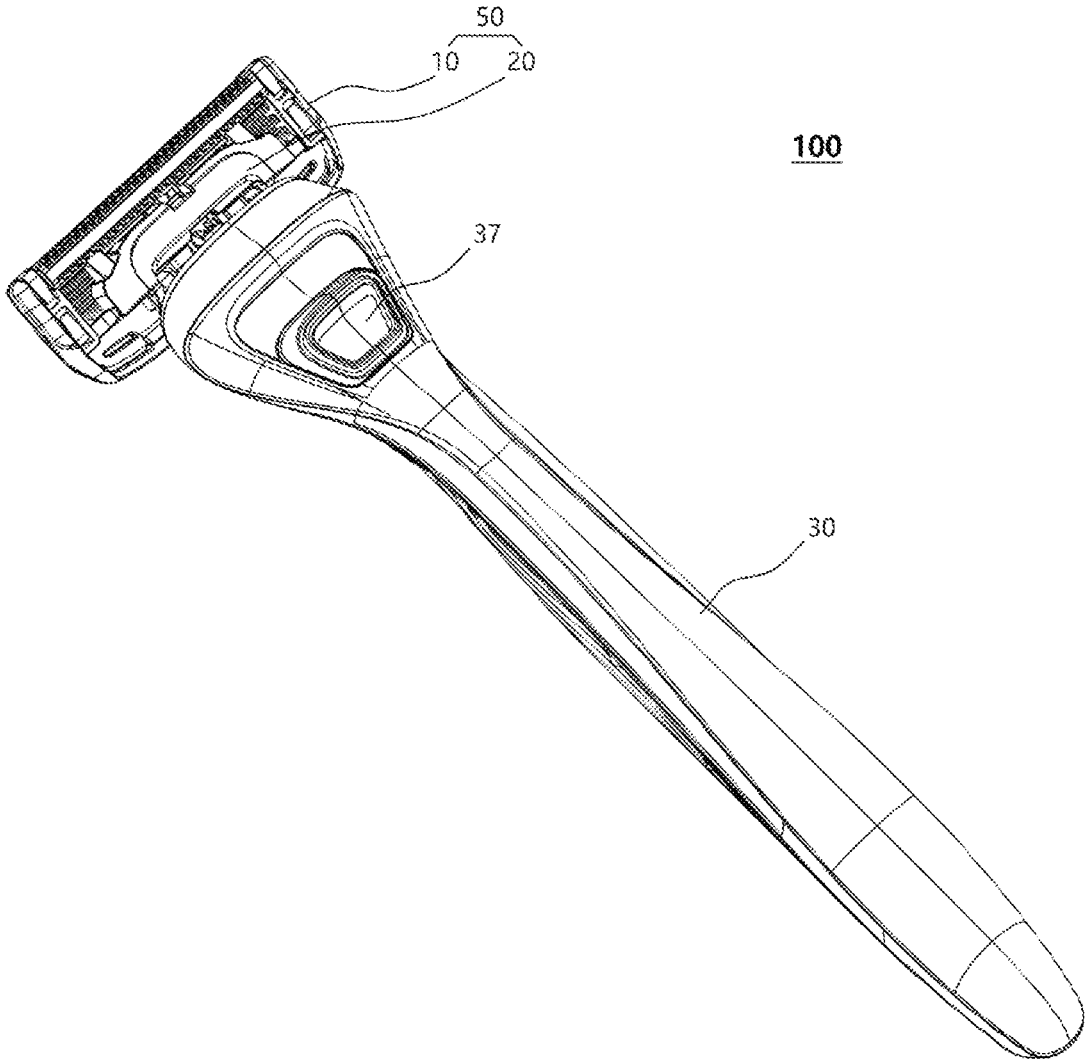
FIG. 1 is a perspective view of a razor according to an embodiment as viewed from the back of a razor handle (where the back of a blade housing is visible)

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the embodiments set forth herein. Rather, these embodiments are provided so that this disclosure will be thorough and complete and will fully convey the concept of the invention to those skilled in the art, and the present disclosure will only be defined by the appended claims. Like reference numerals refer to like elements throughout the specification.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Hereinafter, an embodiment of the present disclosure will be described in detail with reference to the accompanying drawings.

Figure 2:
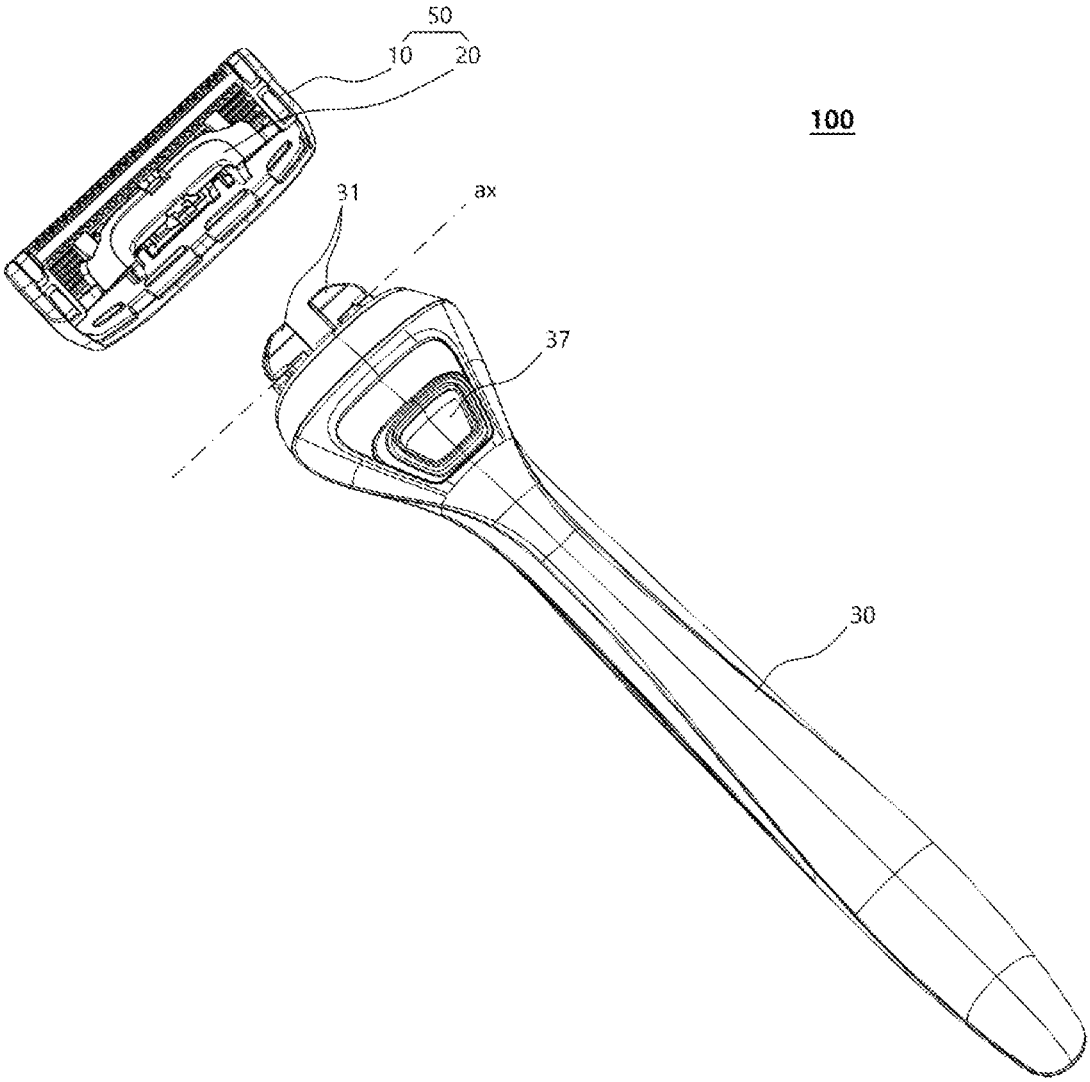
FIG. 2 is a perspective view showing a razor cartridge assembly separated from the razor handle of FIG. 1.

FIG. 1 is a perspective view of a razor 100 according to an embodiment as viewed from the back of a razor handle 30 (where the back of a blade housing 10 is visible). FIG. 2 is a perspective view showing a razor cartridge assembly 50 separated from the razor handle 30 of FIG. 1.

The razor 100 according to an embodiment includes the razor cartridge assembly 50 which includes the blade housing 10 and a connector 20 fixedly coupled to the blade housing 10 and the razor handle 30 which is detachably coupled to the razor cartridge assembly 50. A pair of plunger guards 31 are formed at an end of the razor handle 30. The plunger guards 31 may be inserted into or removed from a coupling space provided in the razor cartridge assembly 50.

In addition, in order to remove the plunger guards 31 of the razor handle 30 from the razor cartridge assembly 50, a slider button 37 disposed on the back of the razor handle 30 may be configured to be pushed in a particular direction, for example toward the razor cartridge assembly 50. In response to manipulation of the slider button 37, a plunger (not shown) under a biasing force between the pair of plunger guards 13 may protrude toward one side of the razor cartridge assembly 50, thereby pushing the side of the razor cartridge assembly 50. Accordingly, the plunger guards 31 may be detached from the razor cartridge assembly 50.

In some embodiments, the plunger guards 31 may swivel within a predetermined angle range with respect to a rotation axis ax formed near the end of the razor handle 30. Accordingly, when coupled to the plunger guards 31, the razor cartridge assembly 50 may also swivel around the rotation axis ax.

Figure 3:
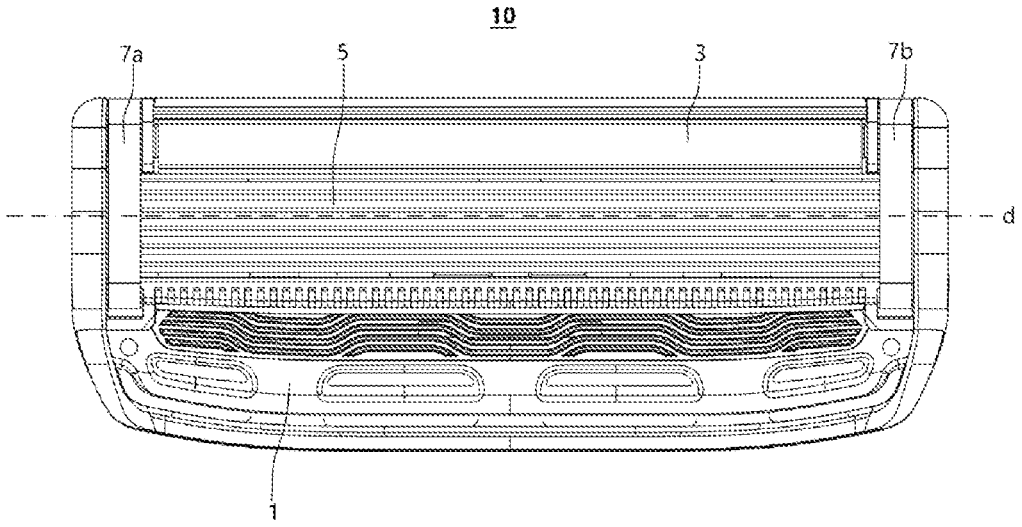
FIG. 3 is a plan view of the blade housing of FIG. 2 as viewed from the front.

FIG. 3 is a plan view of the blade housing 10 of FIG. 2 as viewed from the front.

A razor blade 5 may have a cutting edge at one side, and the other side of the razor blade 5 may be seated in a seating slot provided in the blade housing 10. Here, one razor blade 5 or two or more razor blades 5 may be provided, and a direction in which the razor blade (or blades) 5 is accommodated in the blade housing 10 is a longitudinal direction d perpendicular to a shaving direction.

A pair of clips 7*a* and 7*b* for fixing both ends of the razor blade 5 to the blade housing 10 may be provided in order to prevent the razor blade 5 from being separated from the blade housing 10. The pair of clips 7*a* and 7*b* may cover both ends of the razor blade 5 and pass through one or more through holes formed near the ends of the blade housing 10. In some embodiments, the pair of clips 7*a* and 7*b* may be bent toward a back 11 of the blade housing 10. FIG. 3 shows an embodiment in which the clips 7*a* and 7*b* are wrapped around the blade housing 10 and passed through the through holes from a front of the blade housing 10.

In addition, a guard bar 1 may be provided parallel to the razor blade 5 in front of a position where the razor blade 5 is accommodated in the blade housing 10, and a lubrication band 3 may be provided parallel to the razor blade 5 behind the above position, with respect to a shaving direction. The guard bar 1 may be configured to make a user's hair erect in a direction substantially perpendicular to the shaving direction in order to facilitate cutting of the hair by the razor blade 5, and the lubrication band 3 may be configured to smooth the rough skin after the cutting.

Figure 4:
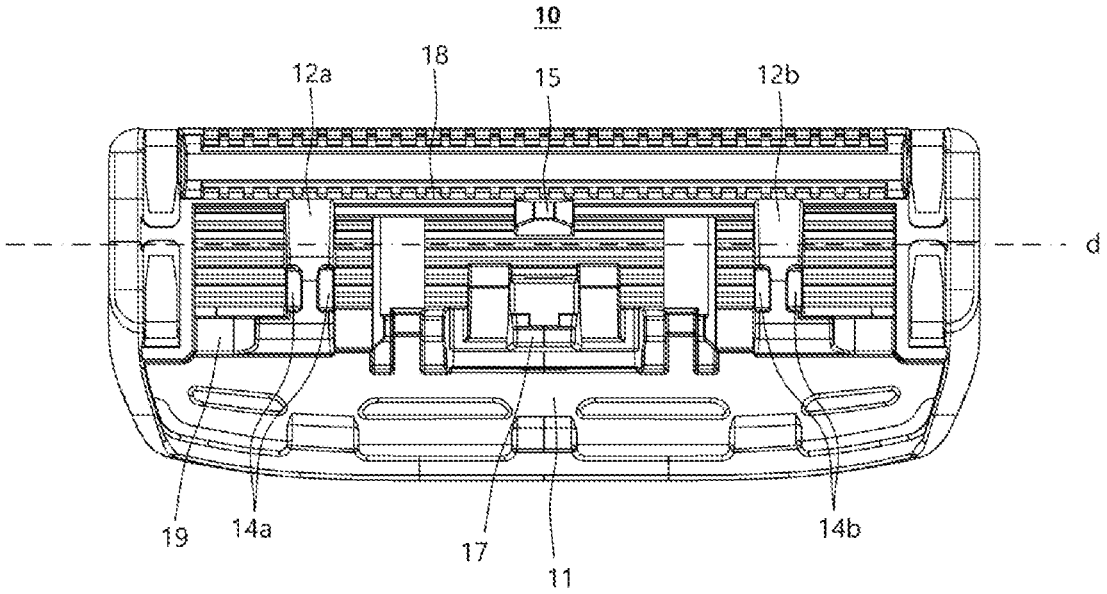
FIG. 4 is a rear view of the blade housing of FIG. 2 as viewed from the back.

FIG. 4 is a rear view of an embodiment of the blade housing 10 of FIG. 2.

In the embodiment, the blade housing 10 may include ribs 12*a* and 12*b* configured to support the blade housing 10 at the back 11 in a direction perpendicular to the longitudinal direction d. The ribs 12*a* and 12*b* may be structures that reinforce the blade housing 10 in a direction perpendicular to the razor blade 5. A pair of ribs 12*a* and 12*b* may be disposed on left and right sides of the blade housing 10, respectively. However, the present disclosure is not limited to this case, and a larger number of the ribs 12*a* and 12*b* can be provided. The ribs 12*a* and 12*b* may include guide slopes 14*a* and 14*b* for guiding the connector 20 to be fastened easily. At the back 11 of the blade housing 10, the guide slopes 14*a* and 14*b* are angled to decline toward opposite sides of the ribs 12*a* and 12*b*, respectively. In an embodiment, a first longitudinal beam 18 may be provided between the razor blade 5 and the lubrication band 3 at the back 11 of the blade housing 10 and comprise a hook coupling portion 15 configured to be fastened to a hook (not shown)

of the connector 20. A second longitudinal beam 19 may be provided between the guard bar 1 and the razor blade 5 at the back 11 of the blade housing 10 and comprise a center bar 17 configured to be pushed in contact with the plunger (not shown) of the razor handle 30. In some embodiments, when the center bar 17 is pushed by the plunger, it may be deformed in a direction opposite to the plunger.

Figure 5A:
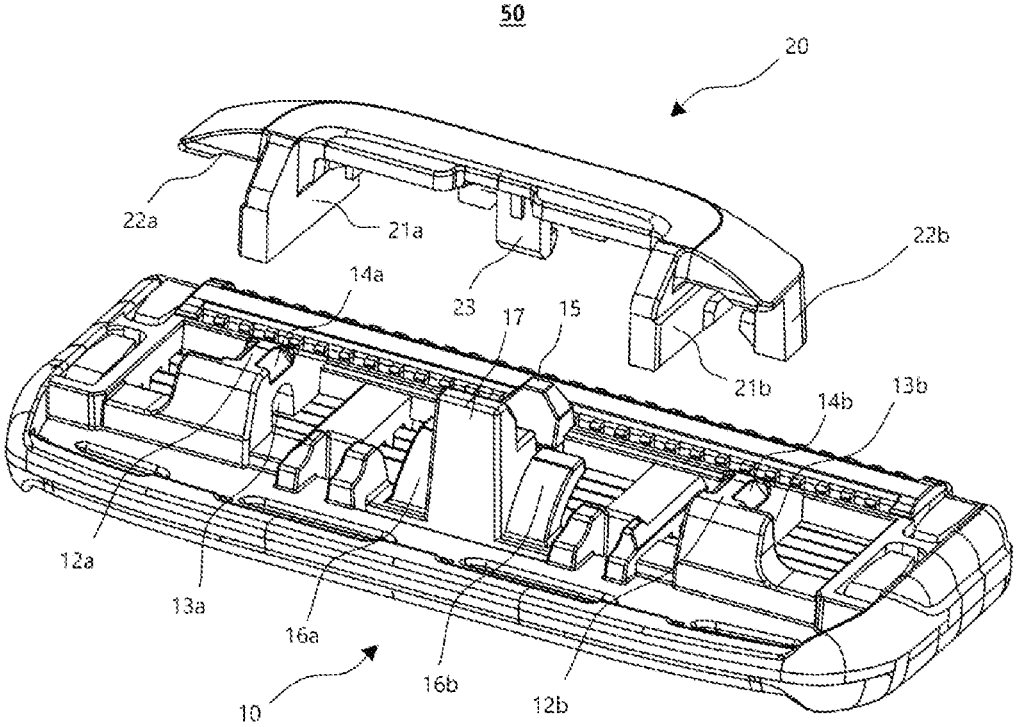
FIGS. 5A, 5B, and 5C are various perspective views of the blade housing and a connector showing a positional relationship between the blade housing and the connector.
Figure 5B:
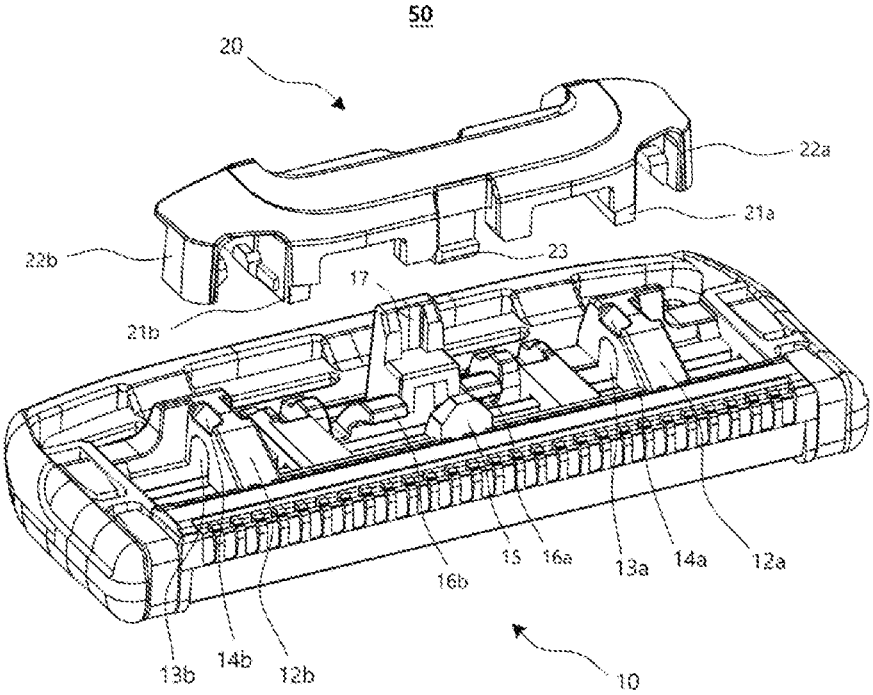
Figure 5C:
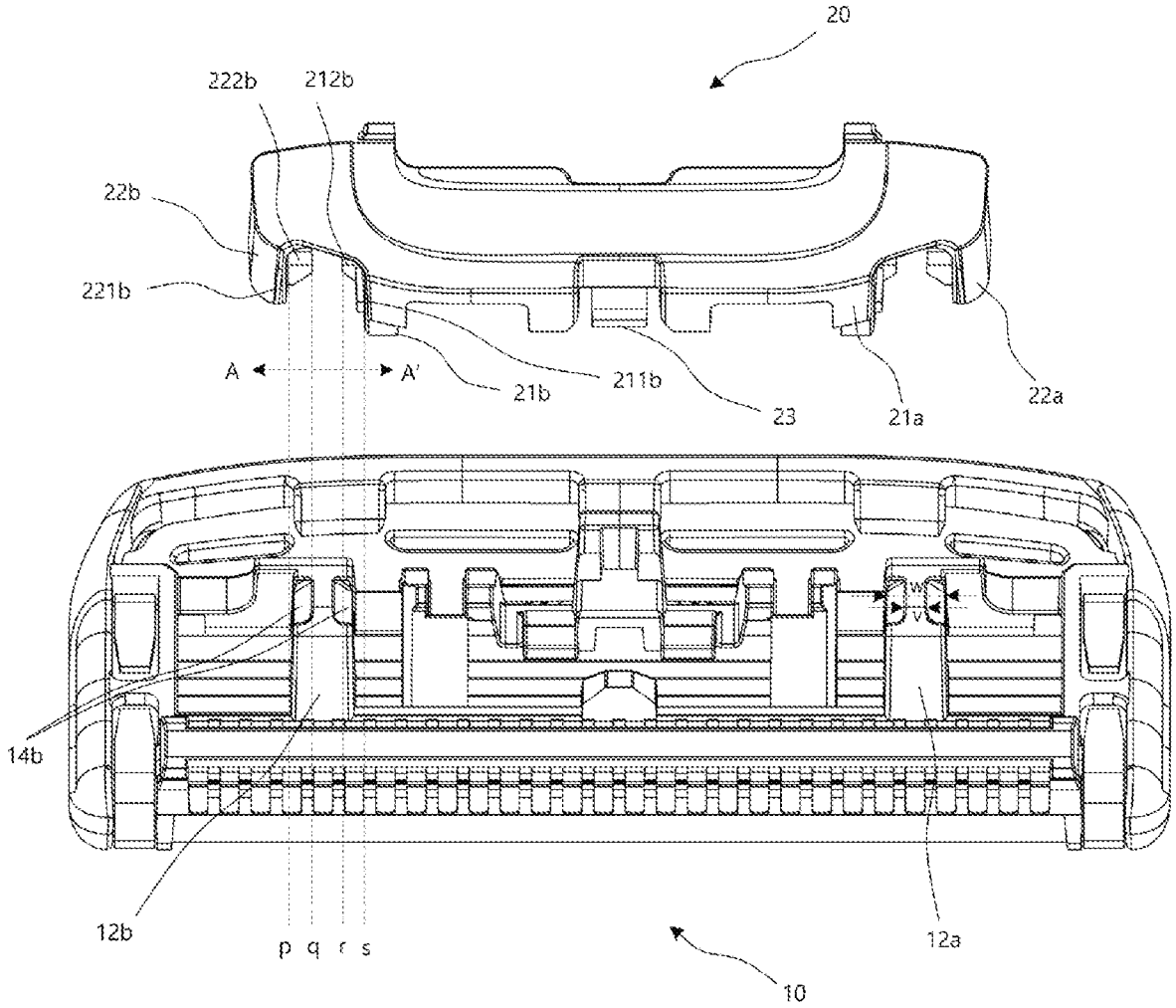

FIGS. 5A through 5C are perspective views of the blade housing 10 and the connector 20 showing the blade housing 10 and the connector 20 before the connector 20 is coupled to the back 11 of the blade housing 10. When the connector 20 is coupled to the back 11 of the blade housing 10, an inner cantilever 21*a*, 21*b* and a corresponding opposing outer cantilever 22*a*, 22*b* (hereinafter, each collectively referred to as inner-outer cantilevers) engage with a corresponding rib 12*a*, 12*b* from both sides. A hook 23 may be provided between two inner-outer cantilever pairs at the connector 20 and be configured to be coupled to the hook coupling portion 15 provided between the ribs 12*a*, 12*b* at the back 11 of the blade housing 10. Here, the inner-outer cantilevers may engage with the ribs 12*a*, 12*b* from both sides at the same time as the hook 23 engages with a step 151 (see FIG. 7B) formed on an inner side of the hook coupling portion 15. Accordingly, the connector 20 and the blade housing 10 may be securely coupled to each other.

The engagement between the ribs 12*a* and 12*b* and the inner-outer cantilevers will now be described in more detail with reference to FIG. 5C. In FIG. 5C, the connector 20 and the blade housing 10 before being coupled together are shown. Here, inner snap protrusions 212*a* and 212*b* are respectively provided on outer surfaces 211*a* and 211*b* of the inner cantilevers 21*a* and 21*b* facing the outer cantilevers 22*a* and 22*b*, and outer snap protrusions 222*a* and 222*b* are respectively provided on inner surfaces 221*a* and 221*b* of the outer cantilevers 22*a* and 22*b* facing the inner cantilevers 21*a* and 21*b*. When the blade housing 10 and the connector 20 are coupled together, the inner snap protrusions 212*a* and 212*b* and the outer snap protrusions 222*a* and 222*b* are respectively engaged with corresponding insertion grooves 13*a* and 13*b* (see FIGS. 5A and 5B) the ribs 12*a* and 12*b*, securing the connector 20 and the blade housing 10 together. Detail will be discussed with respect to engagement between one set of inner-outer cantilevers 21*b*, 22*b* and rib 12*b*, however it will be understood that the discussion may also apply to other similar aspects of the present disclosure, for example inner-outer cantilevers 21*a*, 22*a* and rib 12*a*.

In a state where the blade housing 10 and the connector 20 are aligned as shown in FIG. 5C, the inner surface 221*b* of the outer cantilever 22*b* may substantially align with an outer surface of the rib 12*b* (denoted by line p), and an inner end of the outer snap protrusion 222*b* provided on the inner surface 221*b* of the outer cantilever 22*b* may substantially align with an upper end of the outer guide slope 14*b* formed at the front of the rib 12*b*. In some embodiments, the outer surface 211*b* of the inner cantilever 21*b* and an outer end of the inner snap protrusion 212*b* provided on the outer surface 211*b* of the outer cantilever 22*b* may be slightly displaced toward the center of the blade housing 10 (e.g., toward the hook 23) compared with the inner guide slope 14*b* and an inner surface of the rib 12*b* (denoted by lines r and s). Thus some clearance may be provided so that the inner-outer cantilevers 21*b* and 22*b* of the connector 20 can be smoothly engaged with the rib 12*b*. The guide slopes 14*b* may cause a gap between the inner snap protrusion 212*b* and the outer snap protrusion 222*b* to be widened to provide for insertion of the inner snap protrusion 212*b* and the outer snap protrusion 222*b* into the insertion groove 13*b*.

In an embodiment, the inner surface 221*b* and the outer snap protrusion 222*b* of the outer cantilever 22*b* and the outer surface 211*b* and the inner snap protrusion 212*b* of the inner cantilever 21*b* may be equally displaced on both sides of the center of the rib 12*b*. In some cases, the inner end of the outer snap protrusion 222*b* and the outer end of the inner snap protrusion 212*b* may contact each other at the time of assembling the connector 20 and the blade housing 10.

In some embodiments, a gap (between lines q and r) between the ends of the outer snap protrusion 222*b* and the inner snap protrusion 212*b* before assembly may be smaller than a width w of the rib 12*b* and greater than a width v (smallest distance) between the upper ends of the two guide slopes 14*b*.

Therefore, when the inner-outer cantilevers 21*b* and 22*b* are coupled to the rib 12*b*, the gap between the inner snap protrusion 212*b* and the outer snap protrusion 222*b* is increased (in a A-A' direction) up to a maximum of the width w of the rib 12 as the inner-outer cantilevers 21*b* and 22*b* are moved downward along the guide slopes 14*b*. Then, as the inner snap protrusion 212*b* and the outer snap protrusion 222*b* are inserted into the insertion grooves 13*b* formed on both side surfaces of the rib 12*b*, the inner snap protrusion 212*b* and the outer snap protrusion 222*b* may move toward each other such that the gap between them is reduced again.

Each of the inner cantilever 21*b* and the outer cantilever 22*b* may be formed to have a cantilever beam structure having an elastic restoring force to an external bending force. Alternatively, one of the inner cantilever 21*b* or the outer cantilever 22*b* may be fixed, and the other stay be formed in a cantilever beam structure.

In FIG. 5C, the coupling relationship between one pair of inner-outer cantilevers 21*b* and 22*b* and the rib 12*b* has been described. As noted, the same may apply to the coupling relationship between another pair of inner-outer cantilevers, for example, 21*a* and 22*a*, and another rib, for example 12*a*, and thus a redundant description will be omitted.

Figure 6A:
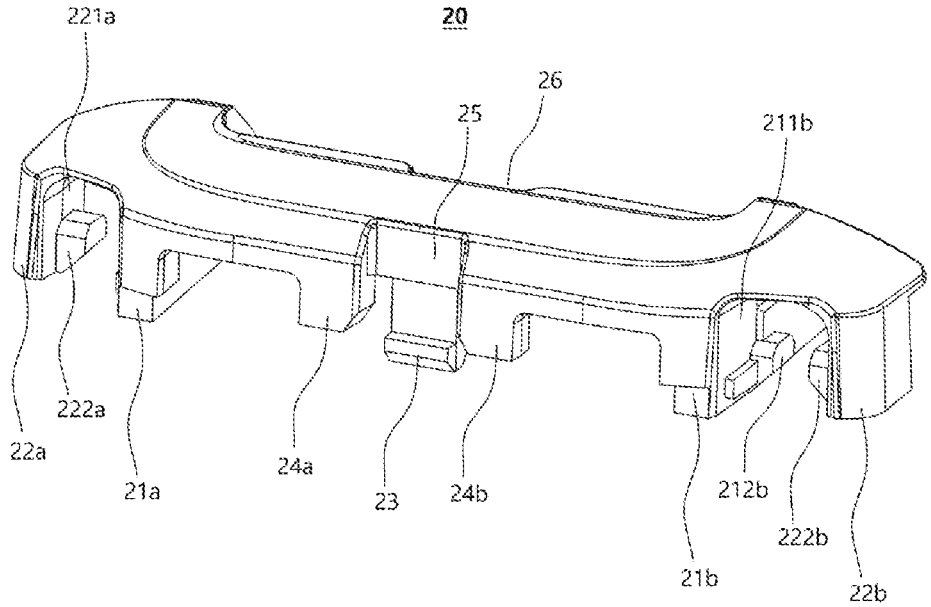
FIGS. 6A, 6B, 6C, and 6D are views of a connector according to an embodiment of the present disclosure.
Figure 6B:
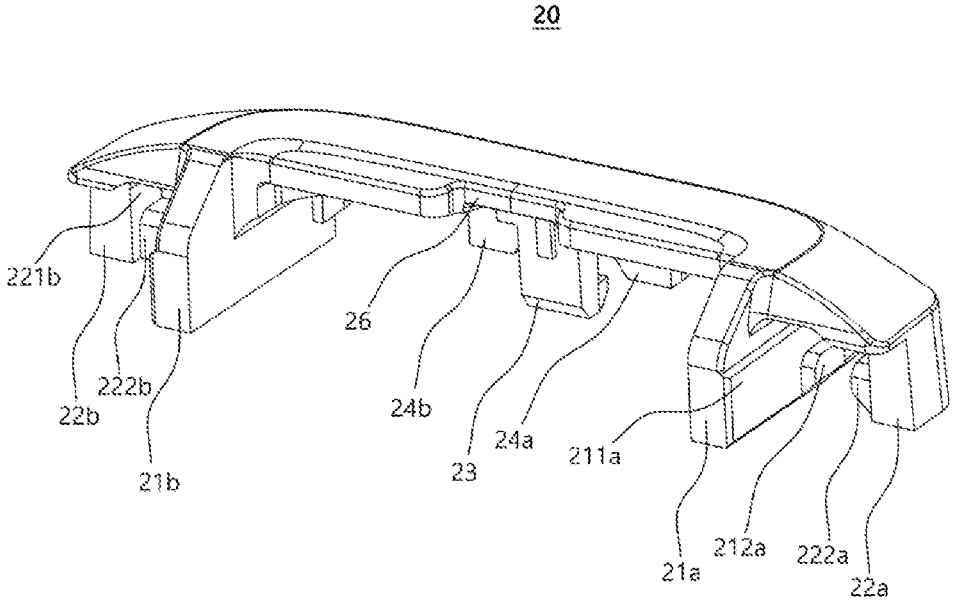
Figure 6C:
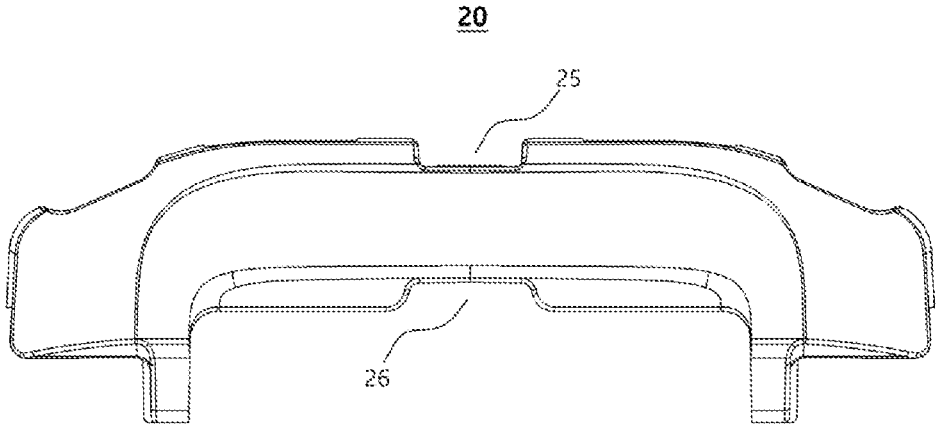
Figure 6D:
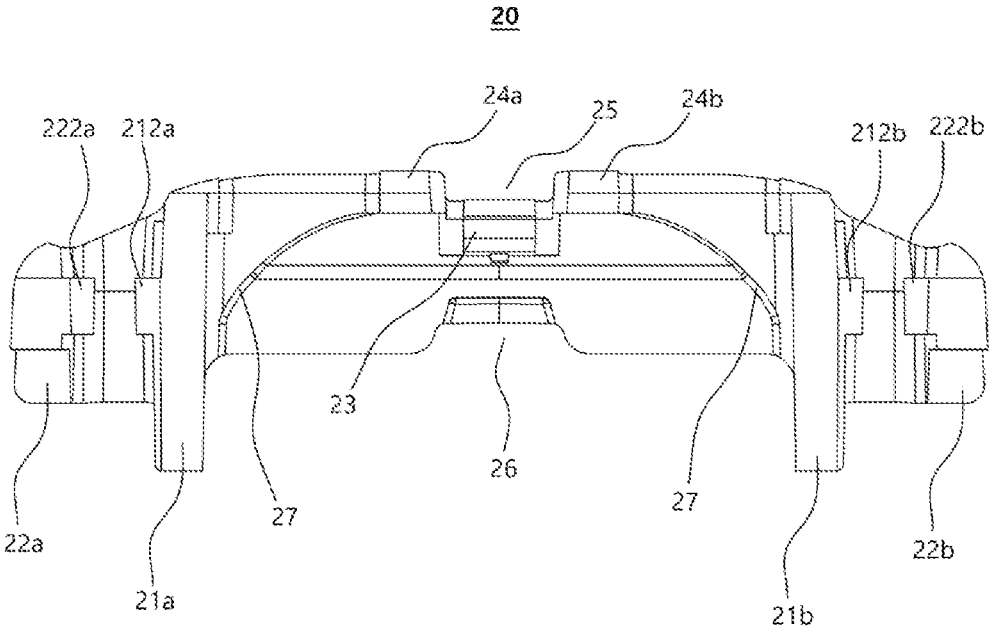

FIGS. 6A through 6D are views of a connector 20 according to an embodiment of the present disclosure. In particular, FIGS. 6A and 6B are perspective views of the connector 20 as viewed from different directions, and FIGS. 6C and 6D are respectively a plan view and a rear view of the connector 20.

When the connector 20 and the blade housing 10 are assembled together, they are coupled such that the combinations of the inner-outer cantilevers 21*a* and 22*a* and 21*b* and 22*b* formed on the right and left sides of the connector 20 are engaged to the ribs 12*a* and 12*b* formed at the corresponding positions of the blade housing 10. This coupling ensures secure assembly of the connector 20 and the blade housing 10 in the longitudinal direction d (see FIG. 4), but may create a minute clearance in a transverse direction, which is perpendicular to the longitudinal direction d, due to an assembly tolerance. Therefore, in some embodiments, the connector 20 may further include the hook 23, which can be coupled to the hook coupling portion 15 of the blade housing 10. Here, an end of the hook 23 may be configured to engage with the step 151 (see FIG. 7B) formed on the inner side of the hook coupling portion 15, thereby further securing the blade housing 10 and the connector 20, and reducing any clearance between them. The hook 23 may be configured to be bent or otherwise displaced as the hook 23 contacts the hook coupling portion 15 and a shape of the hook 23 may be restored and snapped back into place when it engages with the step 151, thereby creating a securing force. (see FIG. 7B). Therefore, more secure coupling between the connector 20 and the blade housing 10 can be ensured.

In some embodiments, the connector 20 may include a pair of projections 24*a* and 24*b* adjacent to the hook 23 and configured to guide the hook coupling portion 15 so that the hook 23 and the hook coupling portion 15 can be coupled together in position. The projections 24*a* and 24*b* may be symmetrical with respect to the hook 23, and a guide slot 25, which is a space in which the hook coupling portion 15 can move while being guided, may be formed between the two projections 24*a* and 24*b*.

A clearance groove 26 is formed on an opposite side of the guide slot 25. When the blade housing 10 and the connector 20 are assembled together, the clearance groove 26 is positioned at a predetermined clearance y (see FIG. 7A) from the center bar 17 of the blade housing 10. When a plunger 36 (see FIG. 9A) of the razor handle 30 protrudes, the center bar 17 is pushed while being elastically deformed to some extent or otherwise displaced in a direction opposite to the plunger 36. At this time, the clearance groove 26 provides a space into which the pushed center bar 17 can be bent.

Referring to FIG. 6D, arc-shaped recesses 27 may be formed on an inner surface of the connector 20. The profile shapes of the recesses 27 may match the contours of the pair of plunger guards 31 (see FIG. 9A) formed at a proximal end of the razor handle 30.

Figure 7A:
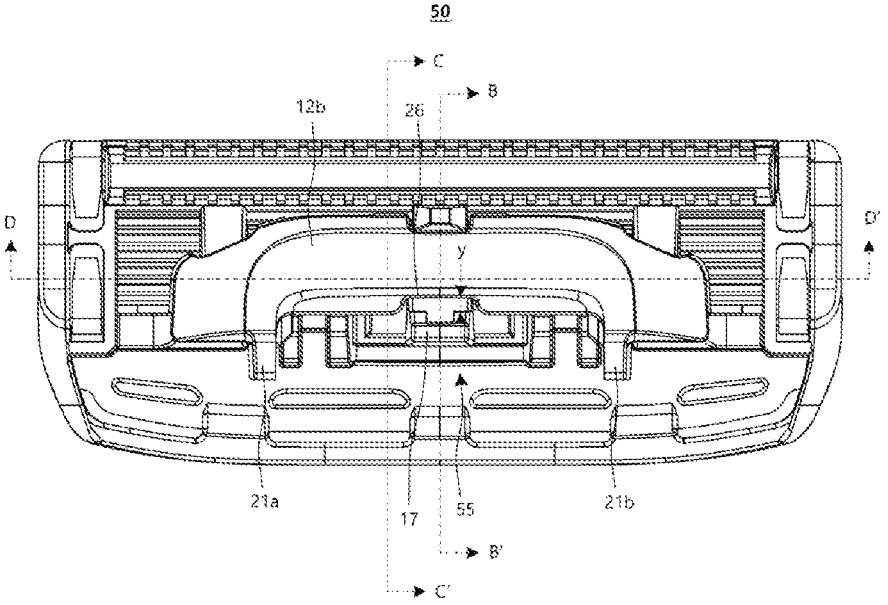
FIG. 7A is a rear view of a razor cartridge assembly according to an embodiment.

FIG. 7A is a rear view of an assembly of the connector 20 and the blade housing 10, that is, the razor cartridge assembly 50.

In a state where the blade housing 10 and the connector 20 are assembled together as described above, a fastening space 55 is formed between the blade housing 10 and the connector 20 into which the proximal end of the razor handle 30 can be inserted in a direction toward the front end of the blade housing 10. At this time, the inner cantilevers 21*a* and 21*b* may define opposing ends of the fastening space 55 in the longitudinal direction d. In some embodiments, the fastening space 55 may be divided into two regions by the center bar 17 of the blade housing 10, and each of the plunger guards 31 may be inserted into the two regions, respectively.

When the razor handle 30 is detached from the assembly 50 in this assembled state, the plunger 36 (see FIG. 9A) of the razor handle 30 may be moved in a forward direction, for example by the user's operation. As the plunger 36 moves in the forward direction, it pushes the center bar 17 and the pair of plunger guards 31 disengage from the fastening space 55. During detachment, the center bar 17 pushed by the plunger 36 may be bent within the range of the predetermined clearance y.

Figure 7B:
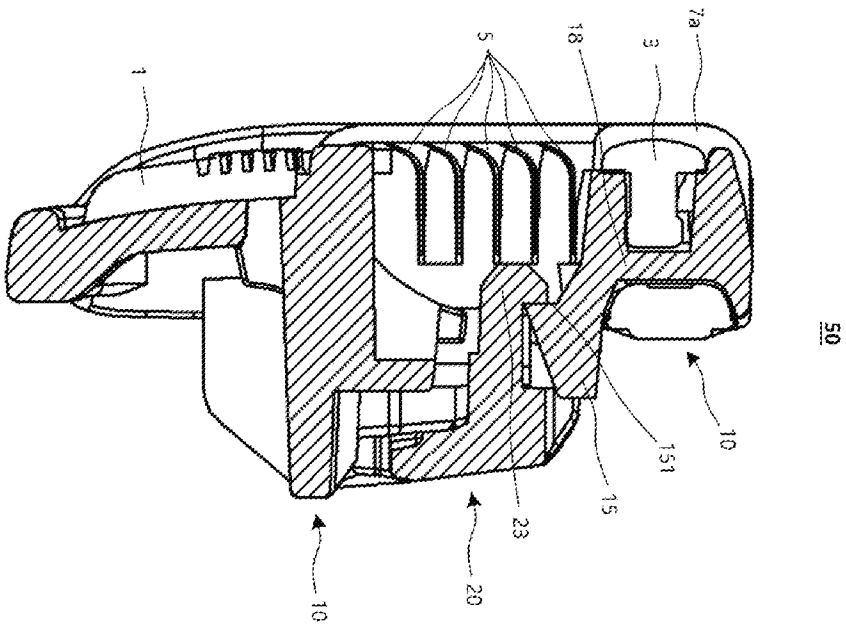
FIG. 7B is a cross-sectional view of the razor cartridge assembly of FIG. 7A, taken along direction B-B'.
Figure 7C:
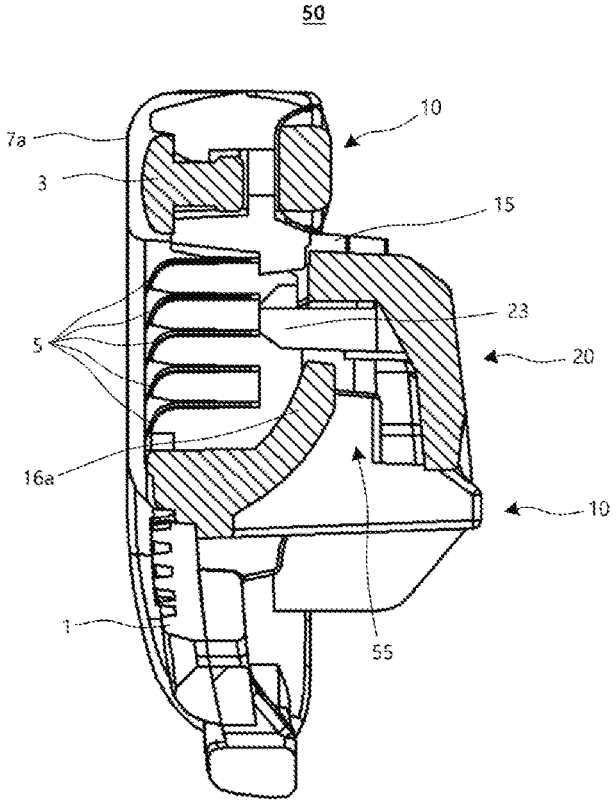
FIG. 7C is a cross-sectional view of the razor cartridge assembly of FIG. 7A, taken along direction C-C'.
Figure 7D:
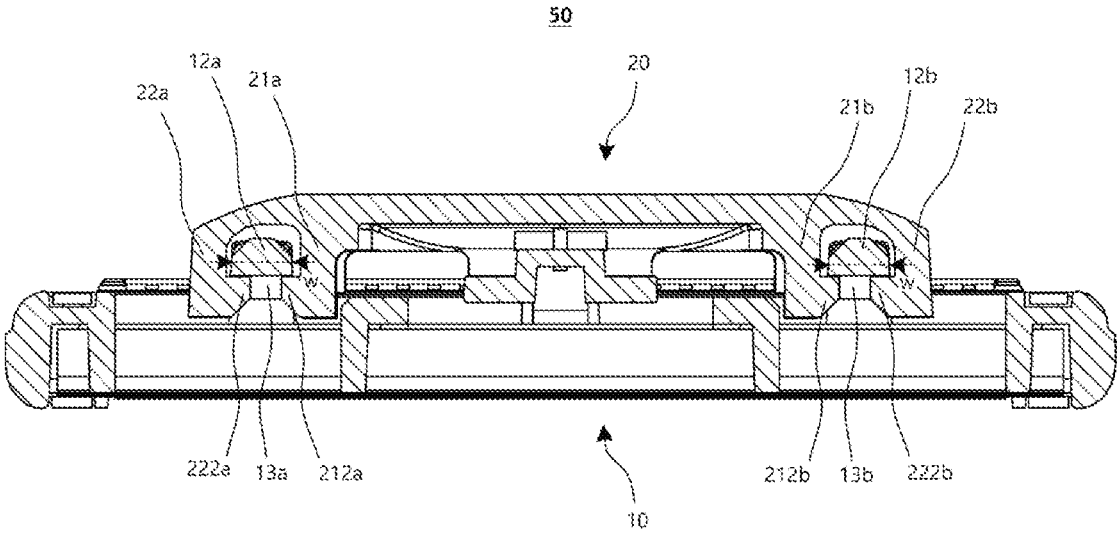
FIG. 7D is a cross-sectional view of the razor cartridge assembly of FIG. 7A, taken along direction D-D'.

FIGS. 7B through 7D are cross-sectional views taken along directions B-B', C-C' and D-D' of FIG. 7A, respectively.

Referring to FIG. 7B, the beam 18 extending in the longitudinal direction d (see FIG. 3) is formed roughly between the razor blade 5 and the lubrication band 3 at the back 11 of the blade housing 10, and the hook coupling portion 15 which can be fastened to the hook 23 of the connector 20 is provided on the back of the transverse beam 18. When the connector 20 and the blade housing 10 are assembled together, an end of the hook 23 is coupled to the inner step 151 of the hook coupling portion 15 formed at a central portion of the blade housing 10. Therefore, after the assembly, the hook 23 is coupled to the hook coupling portion 15, and clearance between the hook 23 and the hook coupling portion 15 is reduced by restoration of the shape and some elasticity of the hook 23. Thus, the connector 20 and the blade housing 10 can be securely coupled together.

Referring to FIG. 7C, a cross-sectional view along direction C-C' is shown. It will be understood that a similar and substantially symmetrical configuration is considered opposite the direction line B-B' and thus the following discussion includes reference to pairs or corresponding elements with substantially similar configurations which may not specifically be shown in FIG. 7C, but can be understood by those of ordinary skill when viewed in context of the other figures of this disclosure.

Thus in FIG. 7C, a fastening space 55 is shown into which the pair of plunger guards 31 formed at the proximal end of the razor handle 30 can be inserted substantially from the back of the guard bar 1. Here, a pair of engaging protrusions 16*a* and 16*b* corresponding to the pair of plunger guards 31 are provided on the left and right sides of the center bar 17, respectively. Therefore, when the pair of plunger guards 31 are inserted into the fastening space 55, stepped grooves 32*a* and 32*b* (see FIG. 9B) formed on the pair of plungers 31 are engaged with the engaging protrusions 16*a* and 16*b*, respectively. The plunger guards 31 coupled to the fastening space 55 in this way maintain the coupled state until the plunger 36 (see FIG. 9A) protrudes and pushes the center bar 17.

Referring to FIG. 7D, a cross-sectional view along direction D-D' is shown. FIG. 7D shows a structure in which the snap protrusions 212*a* and 222*a* or 212*b* and 222*b* formed on each pair of inner-outer cantilevers 21*a* and 22*a* or 21*b* and 22*b* are coupled to the insertion grooves 13*a* or 13*b* formed in the rib 12*a* or 12*b*, respectively. At the time of assembly, since the gap between the snap protrusions 212*a* and 222*a* or 212*b* and 222*b* is smaller than the width w of the rib 12*a* or 12*b*, the inner-outer cantilevers 21*a* and 22*a* or 21*b* and 22*b* are elastically deformed to increase the gap. Then, in the assembled state, the gap between the snap protrusions 212*a* and 222*a* or 212*b* and 222*b* is reduced again when the snap protrusions 212*a* and 222*a* or 212*b* and 222*b* are snap-fit engaged with the insertion grooves 13*a* or 13*b*. Therefore, the connector 20 is not separated rearward from the blade housing 10.

Figure 8A:
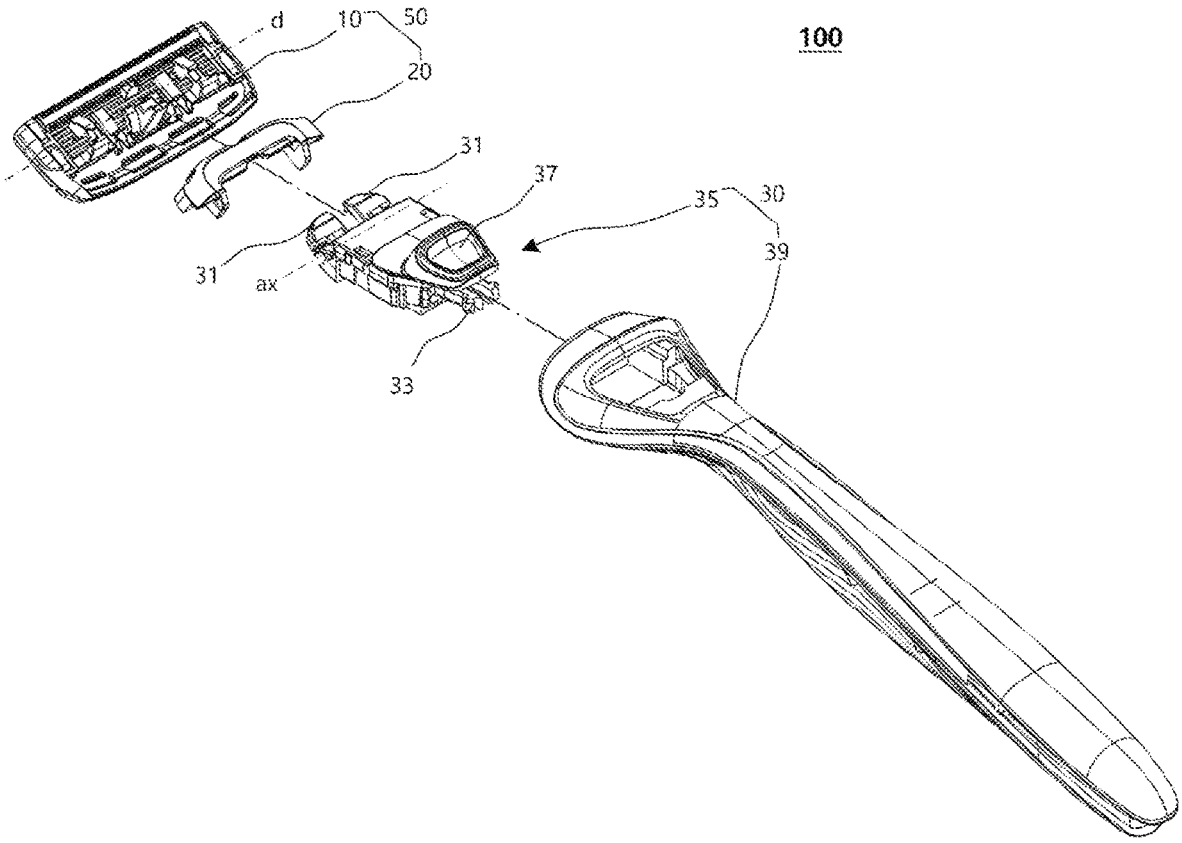
FIG. 8A is an exploded perspective view of the razor according to an embodiment.
Figure 8B:
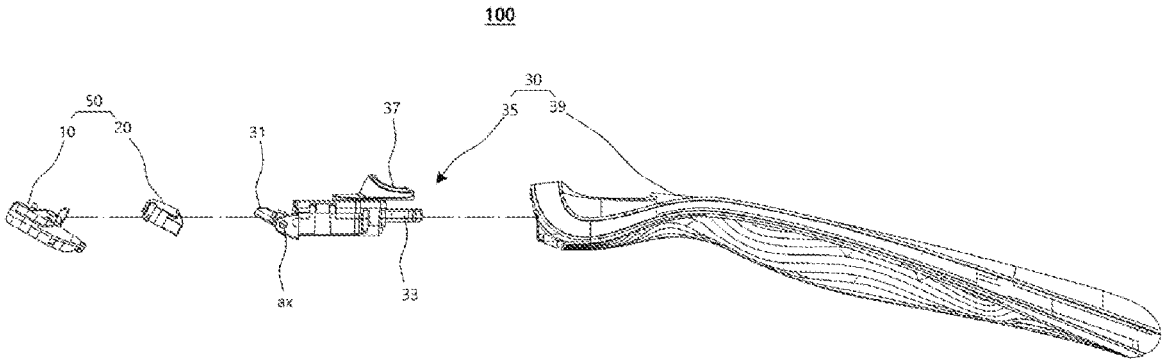
FIG. 8B is a side view of the exploded perspective view of FIG. 8A.
Figure 8C:
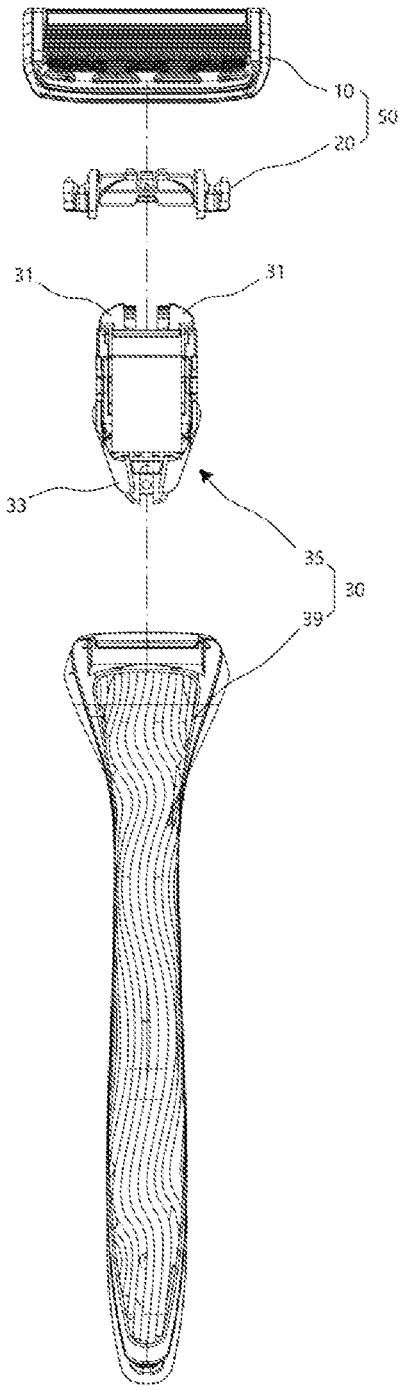
FIG. 8C is a plan view of the exploded perspective view of FIG. 8A.

FIG. 8A is an exploded perspective view of the razor 100 according to an embodiment, FIG. 8B is a side view of the exploded perspective view of FIG. 8A, and FIG. 8C is a plan view of the exploded perspective view of FIG. 8A.

After the blade housing 10 and the connector 20 are assembled into the razor cartridge assembly 50 as described above, the pair of plunger guards 31 may be detachably coupled to the fastening space 55 formed in the razor cartridge assembly 50. The fastening space 55 may be divided into two regions by the center bar 17, and each of the pair of plunger guards 31 may be inserted into the two regions, respectively. That is, when the pair of plunger guards 31 are inserted into the fastening space 55, the center bar 17 occupies the space between the pair of plunger guards 31.

The plunger guards 31 may be provided at a proximal end of a cartridge mount 35. In some embodiments, the cartridge mount 35 is separately provided and configured to be engageable with a handle grip 39. The plunger guards 31 may swivel within a predetermined angle range with respect to the rotation axis ax parallel to the longitudinal direction d of the blade housing 10. Therefore, during shaving, the razor cartridge assembly 50 coupled to the plunger guards 31 may also be swiveled around the rotation axis ax according to the user's operation. A coupling member 33 may be formed at a distal end of the cartridge mount 35 so as to be fastened to a proximal end of the handle grip 39. Alternatively, the cartridge mount 35 may be integrally formed with the handle grip 39 instead of being provided as a separate component.

Figure 9A:
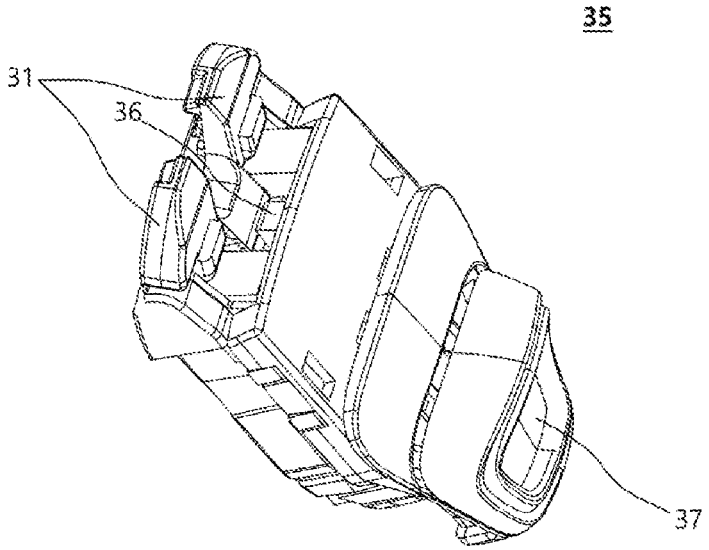
FIG. 9A is a perspective view of a cartridge mount according to an embodiment.

The slider button 37 may be formed on a side of the cartridge mount 35. The user may push the slider button 37 up toward the razor cartridge assembly 50, thereby causing the plunger 36 to protrude. In other embodiments, the slider button 37 may be configured to be pushed inward or in any direction to cause the plunger 36 to protrude. Referring to FIG. 9A, the pair of plunger guards 31 are provided at the proximal end of the cartridge mount 35, and the plunger 36 is formed between the pair of plunger guards 31. When there is no external force being applied, the plunger 36 is disposed at a position where it does not protrude substantially from the cartridge mount 35. In one embodiment, when the user pushes the slider button 37 up toward the razor cartridge assembly 50, the plunger 36 protrudes between the two plunger guards 31 toward the razor cartridge assembly 50. The protruding plunger 36 pushes the center bar 17 (see FIG. 5A), thereby causing the plunger guards 31 coupled to the fastening space 55 to be detached from the razor cartridge assembly 50.

Figure 9B:
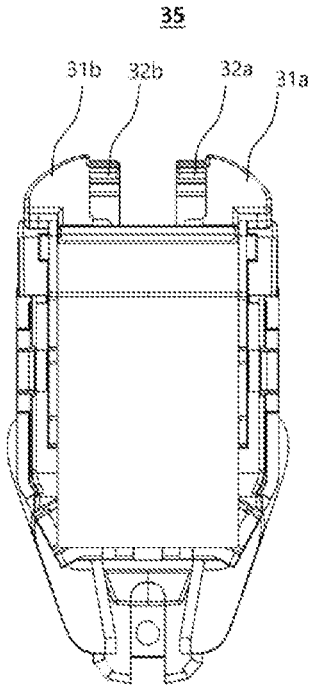
FIG. 9B is an alternate view of the cartridge mount of FIG. 9A.

FIG. 9B is a rear view of the cartridge mount 35 of FIG. 9A as viewed from the front.

The contours of the pair of plunger guards 31 may have profiles that match the recesses 27 (see FIG. 6D) formed on the inner surface of the connector 20. In addition, when the pair of plunger guards 31 are inserted into the fastening space 55, the pair of projections 24*a* and 24*b* (see FIG. 6) formed on the connector 20 serve as stoppers for the pair of plunger guards 31.

When the pair of plunger guards 31 are inserted into the fastening space 55, the stepped grooves 32*a* and 32*b* formed on the pair of plunger guards 31 are engaged with the pair of engaging protrusions 16*a* and 16*b* (see FIG. 5B) formed on the left and right sides of the center bar 17 at the back 11 of the blade housing 10. After the plunger guards 31 are inserted into the fastening space 55, the coupling between the razor cartridge assembly 50 and the razor handle 30 may be stably maintained. The razor handle 30 may be decoupled from the razor cartridge assembly 50 when the plunger 36 is made to push the center bar 17 by the user's operation.

Figure 10A:
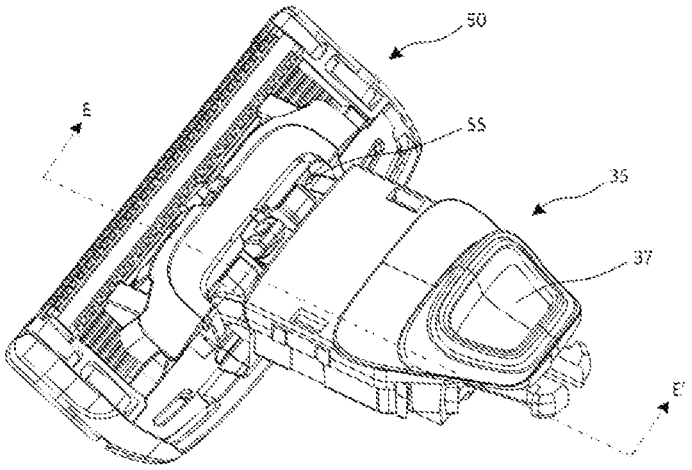
FIG. 10A is a perspective view showing a razor cartridge assembly coupled to a cartridge mount according to an embodiment of the present disclosure.
Figure 10B:
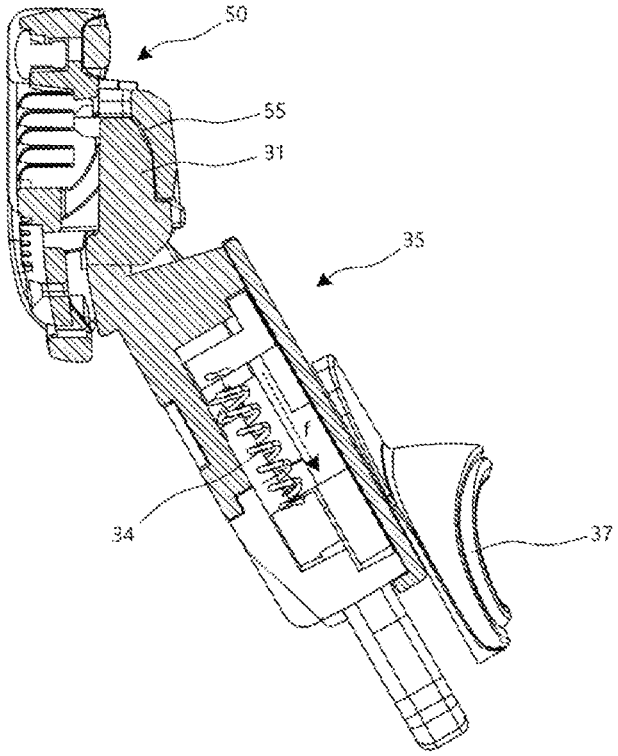
FIG. 10B is a cross-sectional view taken along direction E-E' of the perspective view of FIG. 10A.

FIG. 10A is a perspective view showing a state where the razor cartridge assembly 50 is coupled to the cartridge mount 35. FIG. 10B is a cross-sectional view taken along direction E-E' of FIG. 10A. In FIG. 10A, the pair of plunger guards 31 are inserted into the fastening space 55 of the razor cartridge assembly 50, and the plunger 36 is not protruding from the cartridge mount as the slider button 37 has not been operated. In some embodiments, the plunger 36 and the slider button 37 may be integrally formed and are subjected to a biasing force f toward an initial position by a biasing member, for example, a coil spring 34, (see FIG. 10B). At the initial position, the slider button 37 may be positioned away from the razor cartridge assembly 50 due to the biasing force f of the coil spring 34. Therefore, the plunger 36 is not externally exposed and does not contact the center bar 17 of the blade housing 10, even when the plunger guards 31 swivel. If the user causes the slider button 37 to be moved upward against the biasing force f, the plunger 36 may be moved to push the center bar 17, causing the plunger guards 31 to be detached from the fastening space 55. Ultimately, the razor cartridge assembly 50 is separated from the cartridge mount 35 or the razor handle 30.

According to a razor cartridge assembly of the present disclosure, inner and outer cantilevers are provided which are configured to engage with corresponding ribs formed on the back of a blade housing, providing simple and secure assembly of the razor cartridge assembly.

In addition, according to the razor cartridge assembly of the present disclosure, plunger guards of a razor handle can be easily coupled and decoupled to and from a fastening space formed between the blade housing and a connector.

It will be understood that the effects of the embodiments are not restricted to those set forth herein. The above and other effects of the embodiments will become more apparent to one of ordinary skill in the art to which the embodiments pertain by referencing the claims.

While the present disclosure has been particularly shown and described with reference to exemplary embodiments thereof, it will be understood by those of ordinary skill in the art that various changes in form and detail may be made therein without departing from the spirit and scope of the present disclosure as defined by the following claims. The exemplary embodiments should be considered in a descriptive sense only and not for purposes of limitation.

What is claimed is:

1. A razor cartridge assembly comprising:

one or more razor blades, each having a cutting edge;

a blade housing configured to accommodate the one or more razor blades in a longitudinal direction of the blade housing; and a connector configured to be coupled to a back of the blade housing, wherein:

the blade housing comprises a rib disposed at the back of the blade housing and positioned in a direction perpendicular to the longitudinal direction; and the connector comprises an inner cantilever and an outer cantilever opposite the inner cantilever, wherein the inner cantilever and the outer cantilever are configured to engage with the rib inserted into a space formed between the inner cantilever and the outer cantilever to couple the blade housing and the connector together.

2. The razor cartridge assembly of claim 1, further comprising an inner snap protrusion disposed on the inner cantilever and an outer snap protrusion disposed on the outer cantilever such that the inner snap protrusion and the outer snap protrusion face each other, wherein the rib comprises insertion grooves on both sides of the rib such that the insertion grooves engage with the inner snap protrusion and the outer snap protrusion.

3. The razor cartridge assembly of claim 2, wherein the rib further comprises guide slopes for guiding the inner snap protrusion and the outer snap protrusion toward the insertion grooves.

4. The razor cartridge assembly of claim 2, wherein the inner cantilever and the outer cantilever are elastically deformable such that a gap between the inner cantilever and the outer cantilever is increased when the inner cantilever and the outer cantilever are moved toward the insertion grooves to couple the blade housing and the connector together.

5. The razor cartridge assembly of claim 1, wherein:

the blade housing further comprises at least one hook coupling portion formed on the back of the blade housing; and the connector further comprises a hook at a position corresponding to the at least one hook coupling portion and configured to be coupled to the at least one hook coupling portion.

6. The razor cartridge assembly of claim 5, wherein the blade housing further comprises a second rib such that the blade housing comprises a pair of ribs including the rib and the second rib, and the hook coupling portion is formed between the pair of ribs at the back of the blade housing.

7. The razor cartridge assembly of claim 5, wherein the connector further comprises a pair of projections adjacent to the hook and configured to provide a guide slot for guiding the hook coupling portion to be coupled to the hook.

8. The razor cartridge assembly of claim 1, wherein when the blade housing and the connector are coupled together, a fastening space is defined between the blade housing and the connector to accommodate insertion of a proximal end of a razor handle in a direction toward a front end of the blade housing.

9. The razor cartridge assembly of claim 8, wherein the connector further comprises a second inner cantilever such that the connector comprises a pair of inner cantilevers which include the inner cantilever and the second inner cantilever that define opposite ends of an opening corresponding to the fastening space in the longitudinal direction.

10. The razor cartridge assembly of claim 8, wherein the blade housing further comprises a center bar extending rearward from the back of the blade housing.

11. The razor cartridge assembly of claim 10, wherein the connector further comprises a clearance groove defining a clearance area between the center bar and the connector when the blade housing and the connector are coupled together.

12. The razor cartridge assembly of claim 11, wherein:

a pair of plunger guards are provided at the proximal end of the razor handle and are configured to pivot around a rotation axis parallel to the longitudinal direction;

the fastening space is divided into two regions by the center bar when the blade housing and the connector are coupled together; and the pair of plunger guards are configured to be respectively inserted into the two regions of the fastening space.

13. The razor cartridge assembly of claim 12, wherein the razor handle further comprises a moveable plunger disposed between the pair of plunger guards and configured to be moved to push the center bar to cause the razor handle to be detached from the razor cartridge assembly.

14. The razor cartridge assembly of claim 12, wherein the connector is shaped to define recesses configured to correspond to contours of the pair of plunger guards.

15. The razor cartridge assembly of claim 14, wherein:

the blade housing further comprises a hook coupling portion formed on the back of the blade housing;

the connector further comprises a hook at a position corresponding to the hook coupling portion and configured to be coupled to the at least one hook coupling portion;

the connector further comprises a pair of projections adjacent to the hook and configured to provide a guide slot for guiding the hook coupling portion to be coupled to the hook; and the pair of plunger guards are configured to abut the pair of projections when the pair of plunger guards are inserted into the fastening space.

16. The razor cartridge assembly of claim 12, wherein when the pair of plunger guards are inserted into the fastening space, the center bar occupies a space between the pair of plunger guards.

17. The razor cartridge assembly of claim 16, wherein the blade housing further comprises a pair of engaging protrusions on left and right sides of the center bar at the back of the blade housing and configured to be engaged with stepped grooves on the pair of plunger guards when the pair of plunger guards are inserted into the fastening space.

* * * * *